United States Patent [19]

Pasternack

[11] Patent Number: 4,955,374

[45] Date of Patent: Sep. 11, 1990

[54] CLOSED CYCLE GAS MASK AND BREATHING EQUIPMENT FOR OPERATION UNDER PRESSURE HAVING A SEVERANCE-OPERATED CONNECTION SHUT-OFF FOR THE BREATHING EQUIPMENT

[75] Inventor: Adalbert Pasternack, Bad Schwartau, Fed. Rep. of Germany

[73] Assignee: Drägerwerk Aktiengesellschaft, Lübeck, Fed. Rep. of Germany

[21] Appl. No.: 353,400

[22] Filed: May 17, 1989

[30] Foreign Application Priority Data

Jul. 9, 1988 [DE] Fed. Rep. of Germany ..... 3823383

[51] Int. Cl.[5] ..... A62B 18/10

[52] U.S. Cl. ..... 128/207.12; 128/202.27

[58] Field of Search ..... 128/207.16, 207.12, 128/205.24, 206.15, 202.27

[56] References Cited

U.S. PATENT DOCUMENTS

| | | | |
|---|---|---|---|
| 1,005,816 | 10/1911 | Drager | 128/202.27 |
| 2,985,169 | 5/1961 | Elling | 128/205.24 |
| 3,435,839 | 4/1969 | Elder | 128/205.24 |
| 3,467,093 | 9/1969 | Hotz et al. | 128/205.24 |
| 3,575,206 | 4/1971 | Ulmann | 128/207.12 |
| 4,699,137 | 10/1987 | Schroeder | 128/205.24 |
| 4,850,345 | 7/1989 | Jackson | 128/202.27 |

FOREIGN PATENT DOCUMENTS

| | | | |
|---|---|---|---|
| 203261 | 6/1939 | Switzerland | 128/207.12 |
| 232467 | 9/1944 | Switzerland . | |
| 525586 | 8/1940 | United Kingdom | 128/207.12 |

*Primary Examiner*—Eugene H. Eickholt
*Attorney, Agent, or Firm*—McGlew & Tuttle

[57] ABSTRACT

A closed cycle gas mask and breathing equipment for operation under pressure includes a gas connector connectible to a tubular fitting of the mask with an inhalation line and an exhalation line which open into a joint connection to a mask. The connection has a device for preventing the escaping of gas from the mask by closing the connection when the connection is undone from the mask. The wearer can disconnect himself from the cycle or enter it without a considerable loss of gas. For this purpose the connector has a non-return valve which when disconnected blocks the breathing gas supply in the inhalation direction which is mounted in the opening of the connector and which is held open by an actuator or detector provided at the mask tubular fitting when the mask is connected.

6 Claims, 1 Drawing Sheet

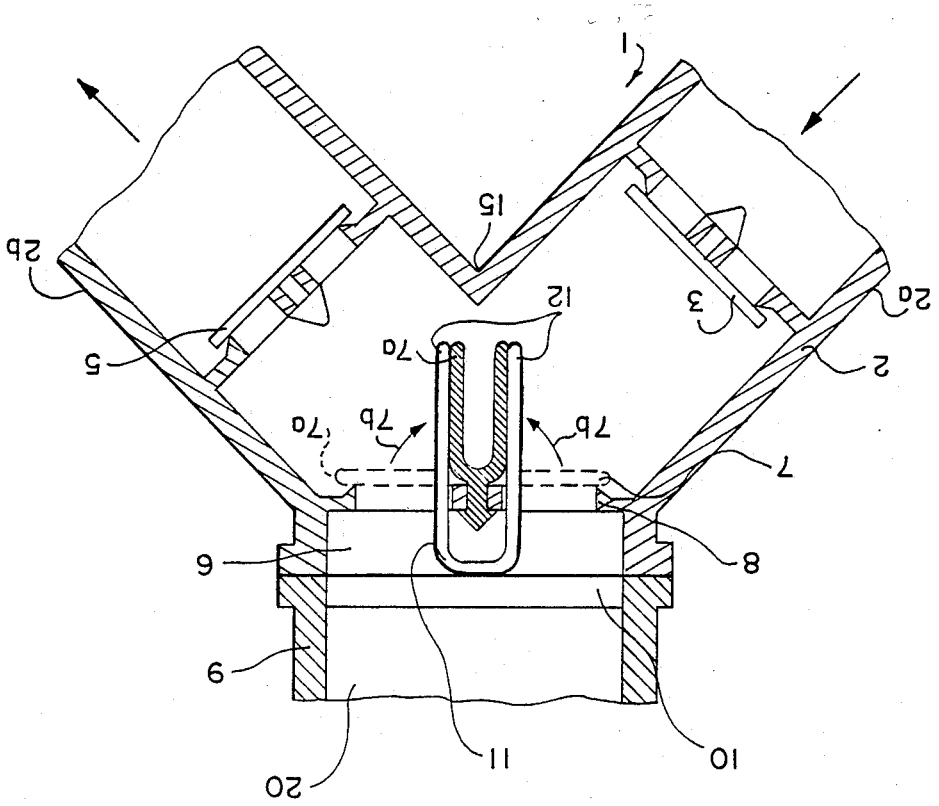
1
2a
2b
2
3
5
6
7
7a
7b
8
9
10
11
12
15
20

CLOSED CYCLE GAS MASK AND BREATHING EQUIPMENT FOR OPERATION UNDER PRESSURE HAVING A SEVERANCE-OPERATED CONNECTION SHUT-OFF FOR THE BREATHING EQUIPMENT

BACKGROUND OF THE INVENTION

FIELD OF THE INVENTION

This invention relates, in general, to gas masks and, in particular to a new and useful gas mask having a supply connection for a breathing gas which effects the automatic shut-off of the breathing gas connection when it is disconnected from the mask.

The invention relates particularly to a closed cycle gas mask and breathing equipment for supplying breathing air operation under pressure which includes an inhalation line and an exhalation line which open into a joint or tubular connection of a mask, wherein during the release of the connection the escaping of respiratory air from the breathing equipment is prevented by means of a switch-off device.

A similar closed cycle gas mask and breathing equipment is known from German patent No. 34 29 345.

In the known closed-cycle breathing equipment the pressure in the respiratory cycle is generated and controlled by means of a pneumatic piston-cylinder unit fed by a respiratory air source by exerting a respective pressure on an air bag in the respiratory cycle. If a sudden pressure drop occurs, e.g. due to the separation of the mask from the face or from the apparatus, the air bag is compressed by means of the piston-cylinder aggregate, and the circulation of the respiratory air breaks down due to the missing pressure. The known switch-off device has the disadvantage that it has to be actuated by means of complex pneumatic control elements and monitors.

SUMMARY OF THE INVENTION

The present invention provides a simple switch-off means which allows the user to disconnect himself from the cycle without any major loss of gas by the breathing equipment or to connect with it while the cycle remains ready for use and under pressure.

According to the invention, a gas switch-off device for closing and opening the breathing gas connection to the mask comprises a non-return valve blocking the gas supply in the inhalation direction, which is arranged in the opening of the breathing gas connection device or connection fitting and which is held open by means of a detector device carried either by the mask or the breathing gas connection and opens the valve when the is connected to the breathing gas supply.

The basic advantage of the invention is that the non-return valve is closed instantly upon the separation of the mask from the breathing gas device connection piece due to the pressure prevailing in the respiratory air cycle or with the aid of a biasing spring acting in a closing direction. Therefore respiratory air cannot escape into the environment. The breathing equipment remains ready for use, so that an immediate respiratory air supply is guaranteed for a subsequent putting on and connection of the mask. During the ready-for-use stage the capacity of the device is saved and the user can breathe the surrounding air through the mask or take the mask off, depending on the circumstances. In the same manner the closure resulting from the de-coupling can be used for a temporary removal of the complete device.

The non-return valve is preferably a disc valve whose flexible disk is folded or moved in the direction opposite its closing direction by means of a fork-shaped detector element in the mask connection. When the mask is taken off, the disc pops against the valve seat due to its intrinsic spring action and is pressed against it by the pressure prevailing in the respiratory air cycle. When the mask is connected, the forked detector element pushes against the disc in the opening direction of the non-return valve and folds the disc along a diameter as the folding line with its halves toward the back into the inner chamber of the respiratory air line. By this means the flow of the respiratory air from the respiratory air line into the mask is obstructed at least.

In a particularly simple embodiment, the detector element is formed from a wire hoop attached to a web in the mask connection. Such a wire hoop construction is lightweight, represents hardly any flow resistance in the respiratory air cycle when the mask is connected, and can be cleaned easily.

Accordingly, it is an object of the invention to provide a gas mask construction which comprises a tubular breathing gas connection having a detector actuator which engages with a valved passage of a breathing gas fitting and opens the passage when the fitting is connected to the mask and closes the passage when it is disconnected so that the breathing gas fitting will be closed when it is severed from the mask.

A further object of the invention is to provide a gas mask construction and a gas mask breathing gas construction which are simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawing and descriptive matter in which a preferred embodiment of the invention is illustrated.

BRIEF DESCRIPTION OF THE DRAWINGS

The only FIGURE of the drawing is a schematic sectional view of a gas mask having a breathing gas connection constructed in accordance with the invention.

DETAILED DESCRIPTION OF THE DRAWINGS

Referring to the drawing, in particular, the invention embodied therein comprises a gas mask construction generally designated 1 which comprises a gas mask 20 having a tubular mask connection 9 which has detector actuator means 10 which includes a web and a detector 11 which is of U-shaped configuration and is mounted on the web 10 and has legs 12, 12 which project in the direction of flow through the connection 9.

In accordance with the invention, the gas mask construction 1 includes a breathing gas fitting generally designated 2 which is engageable with the mask connection 9 and which defines valved passage means in the form of a valve member 7 which is engageable on a seat 8 to close off an opening 6 entering into the breathing gas fitting 2 and the fitting 2 is connected to the mask 9. Construction is such that when the parts are connected together, a detector actuator 11 moves the valve 7 so that it opens the passage and permits breathing gas to pass through an inlet valve 3 to the mask and be discharged through an outlet valve 5 from the mask.

The breathing gas connection or gas connector 15 includes an inhalation branch 2a with an inhalation valve 3 and an exhalation branch 2b with an exhalation valve 5 which opens into the gas connector 15. A non-return valve generally designated 7 is arranged in a connection opening 6 in the connector 15. The valve 7 comprises a disk 7a which engages on a valve seat 8. The opening 6 of the connector 15 is connected to a mask connection or tube 9 which is part of a gas mask 20. A web 10 is mounted or formed inside the mask connection and it carries a fork-shaped hoop 11, both of whose legs 12, 12 press the flexible disk 7 in the directions of arrows 7b away from the valve seat 8 and into the inner chamber of the connector 15.

If the mask connection 9 is disconnected from the connector 15, the fork's legs 12 release the disc 7, so that due to its intrinsic elasticity the disc settles onto the valve seat 8 (this position of the disc 7 is shown in a broken line). The device connection piece 15 is therefore sealed off from the surrounding atmosphere, and the gas in the breathing cycle cannot escape into the environment despite the pressure.

While a specific embodiment of the invention has been shown and described in detail to illustrate the application of the principles of the invention, it will be understood that the invention may be embodied otherwise without departing from such principles.

What is claimed is:

1. A gas mask construction comprising a tubular breathing gas connection, a detector actuator mounted on said breathing gas connection, a breathing gas fitting engageable with said breathing gas connection, and valved passage means carried by one of said breathing gas connection and said breathing gas fitting and opening said valve passage means when they are interconnected and closing said breathing gas fitting upon severance of the connection between said breathing gas fitting and said breathing gas connection.

2. A gas construction according to claim 1, wherein said breathing gas fitting includes an inhalation branch having a valve therein permitting flow in an inhalation direction through said fitting to said mask breathing gas connection and an exhalation branch having a valve permitting flow into said breathing gas fitting exhalation branch.

3. A closed cycle gas mask and breathing equipment for operation under pressure, comprising a breathing equipment having an inhalation line and an exhalation line opening into a joint connection, said mask having a tubular member defining a breathing equipment connection, said joint connection of said breathing equipment having a valve therein for closing and opening said joint connection, switch-off means carried by said gas mask connection which engages in said joint connection, said joint connection having a valve member closing off the passage into said joint connection mounted in the opening of said joint connection, and a detector provided at said mask connection engageable with said valve to open said valve when said mask is connected to said joint connection to permit flow from said joint connection to said mask and from said mask to said joint connection.

4. A closed cycle gas mask according to claim 3, wherein said non-return valve comprises a disk valve including a flexible disk member which is foldable, said detector having means to engage said disk valve and fold it to open it by moving portions thereof off said valve seat, said disk valve being sufficiently flexible to move back onto said valve seat when said detector is moved away from said valve upon severance of said gas connection from said breathing equipment.

5. A closed cycle gas mask according to claim 4, wherein said detector comprises a bent wire hoop having first and second leg portions engageable with respective sides of said flexible valve, said gas mask connection including a web carrying said wire hoop, positioning said hoop in alignment with said valve so said leg portions contact each side of said valve.

6. A gas mask and a breathing gas supply connection, comprising a tubular gas mask connection having a connection opening, a web defined in said gas mask connection adjacent the opening, a U-shaped detector carried by said web and having first and second leg portions projecting out of the opening, a breathing gas supply fitting having a combined gas passage with a combined breathing gas passage opening, inhalation and exhalation branch lines of said breathing gas supply fitting interconnected to said combined gas passage and said combined gas passage opening, a valve having a valve seat in said combined breathing gas passage opening, a valve engageable on said valve seat to close said combined breathing gas passage opening and being flexible and having a central portion mounted in said breathing gas supply fitting and peripheral portions which engage against said valve seat and are movable toward and away from said valve seat to close and open said valve seat, said U-shaped detector having leg portions which engage the peripheral portions of said flexible valve seat to move said valve off said valve seat when said tubular gas mask connection and said breathing gas supply fitting are interconnected, said detector being removable from said valve upon separation of the connection between said gas mask and said breathing gas supply connection to permit said valve to close said breathing gas supply fitting upon disconnection.

* * * * *